United States Patent [19]

Hikuma

[11] Patent Number: 4,803,491

[45] Date of Patent: Feb. 7, 1989

[54] ANTENNA FOR WIRELESS COMMUNICATION EQUIPMENT

[75] Inventor: Hideo Hikuma, Ichikawa, Japan

[73] Assignee: Uniden Corporation, Ichikawa, Japan

[21] Appl. No.: 46,426

[22] Filed: May 6, 1987

[30] Foreign Application Priority Data

May 9, 1986 [JP] Japan ..... 61-104837

[51] Int. Cl.[4] ..... H01Q 1/24

[52] U.S. Cl. ..... 343/702; 455/89; 455/269; 455/351

[58] Field of Search ..... 343/702, 746, 795, 800; 455/89, 90, 269, 347, 351

[56] References Cited

U.S. PATENT DOCUMENTS 2,684,444 7/1954 Fales III ..... 343/746
4,625,212 11/1986 Oda et al. ..... 343/702
4,641,366 2/1987 Yokoyama et al. ..... 343/702

FOREIGN PATENT DOCUMENTS 0039842 4/1978 Japan ..... 343/702
0007204 1/1985 Japan ..... 343/702

*Primary Examiner*—William L. Sikes
*Assistant Examiner*—Doris J. Johnson
*Attorney, Agent, or Firm*—Oblon, Fisher, Spivak, McClelland & Maier

[57] ABSTRACT

An antenna has a main vertical planar part which is connected at its one end to the ground, and a main horizontal planar part which are both arranged in an L-shape. It has a secondary vertical linear part which is arranged in parallel with the main vertical planar part and connected at its one end to the feeding point. It also has a conductive secondary horizontal linear part which is connected between the main horizontal planar part and the secondary vertical linear part and is arranged in parallel with the main horizontal planar part, while being separated from the main horizontal planar part by a definite distance. This makes it possible to incorporate the antenna in the circuit board of wireless communication equipment, and the antenna is particularly suitable for miniaturizing the equipment.

7 Claims, 5 Drawing Sheets

ANTENNA FOR WIRELESS COMMUNICATION EQUIPMENT

BACKGROUND OF THE INVENTION

The present invention relates to antennas for wireless communication equipment, and particularly to improvements in compact plate antennas which are suitable for use as antennas for mobile or portable communication equipment.

A typical configuration for antennas for communication equipment or transceivers mounted aboard vehicles, or for mobile or portable communication equipment such as cordless telephones, has been the classical $\lambda/4$ monopole antenna as typified by the whip antenna. This is the most widespread type and has been used in most cases up to date. Here, $\lambda$ is the wavelength of the frequency f.

Generally speaking, when an antenna is raised to a higher elevation, it becomes proportionally less susceptible to the influences of the topography and surface objects and gains a higher sensitivity in the reception of incoming radio waves. However, as long the aforesaid monopole antennas were used in mobile or portable communication equipment such as those dealt with here, there were restrictions on their height. Since they could not be raised up very high, it was not always possible to achieve a desirable sensitivity.

It is also undesirable to position an antenna too low, and there is the limitation that the aforesaid $\lambda/4$ must be followed at the minimum. Even though there has been a tendency in recent communication equipment to miniaturize the circuit parts remarkably by adopting various types of integrated circuits, no progress has been made in miniaturization of antenna parts, and miniaturization has proved to be entirely unsuitable for the antennas of portable communication equipment which are carried around indoors by a person while speaking, such as the remote units of cordless telephones.

Monopole antennas also have problems in their basic principles of operation. Since the antennas are of the type sensitive to electric fields, they are easily susceptible to the influences of persons or other dielectric substances in the vicinity, and the antenna performance has sometimes deteriorated under the conditions of actual use.

Concerning this point, generally in mobile wireless communications, even if the waves are transmitted from the base station as vertically polarized waves, their plane of polarization becomes inclined as the waves are reflected and scattered by the topography, structures, etc. located in the path of propagation, so that horizontal polarization is sometimes stronger than vertical polarization in the waves when they arrive at a mobile station. This tendency is especially pronounced in cities where there are many tall buildings, steel towers, and the like.

The same may be said about wireless local intercommunication systems. Here also, the waves are reflected and scattered by the equipment installed, and by machines, implements, ceilings, columns, beams and the like, so that very often the waves arriving at a mobile station have a different plane of polarization from the waves which were transmitted.

For this reason, when monopole antennas are used in an attempt to deal with this polarization of the propagated radio waves, one must rely on the so-called polarization diversity effect, for example by positioning two monopole antennas, one vertically and one horizontally. However, such a method is disadvantageous with respect to the space factor in antenna systems for mobile stations.

On account of these circumstances, attempts have begun to be made in the past to use inverted-L antennas such as that shown in FIG. 1, or inverted-F antennas such as that shown in FIG. 2, instead of these monopole antennas. These antennas are easy to miniaturize, are of the type sensitive to magnetic fields and have an effect essentially similar to the polarization diversity effect.

FIG. 1(A) and FIG. 2(A) show the basic configurations of these inverted-L and inverted-F antennas of the past, and FIG. 1(B) and FIG. 2(B) show examples of actual antennas fabricated according to the basic configurations in each case.

Let us first explain the inverted-L antenna 10 shown in FIGS. 1(A) and (B). It consists of a vertical planar part 11 having a width W, and a horizontal planar part 12 which is bent at a right angle while being electrically connected at one end to this vertical planar part 11. The antenna is designed so that the sum of the length L of the horizontal planar part 12 and the height (or length) H of the vertical planar part 11 is equal to $\lambda/4$ with respect to the wavelength $\lambda$ of the frequency used. The feeding point P is located between the bottom of the vertical planar part 11 and the ground or earth E.

In the actual example of an antenna shown in FIG. 1(B), the ground E is configured on the upper surface of the shield housing (ground E) which shields the circuit parts (not shown in the drawing) which are assembled on a printed circuit board B. The inverted-L antenna 10 itself is also supported physically on this printed circuit board B. Of course, the vertical planar part 11, the horizontal planar part 12 and the shield housing E are made of conductive materials, generally suitable metals such as tinned steel sheets, and the printed circuit board B supporting them is made of an insulating materials such as glass epoxy.

The inverted-F antenna 20 shown in FIGS. 2(A) and (B), like the aforesaid inverted-L antenna 10, has a conductive horizontal planar part 22 with a length L and a conductive vertical planar part 21 with a height (or length) H positioned more or less at right angles towards each other, while the two parts are electrically connected to each other on one end. This antenna is also designed so that the sum of the aforesaid lengths (L+H) is equal to $\lambda/4$. However, the bottom of the vertical planar part 21 is directly connected to the ground E, which comprises the shield housing, and the feeding point P is led out from a position separated by a distance D from the connecting point of the vertical planar part 21 and the horizontal planar part 22, as is shown in FIG. 2(A).

As is shown in FIG. 2(B), the distance D can be considered by separating it into two parts: distances $d_1$ and $d_2$. In the inverted-F antenna 20 shown in the drawing, the vertical planar part 21 has a width q less than the width W of the horizontal planar part. This is for the purpose of improving the directivity. The usual practice is to design inverted-L antennas 10 or inverted-F antennas 20 so that the height H of the vertical planar parts 11, 21 is equal to about $\lambda/10$.

The inverted-L and inverted-F antennas shown in FIGS. 1 and 2 are superior in many respects to monopole antennas.

First of all, one may mention that their three-dimensional size can be made much smaller than that of monopole antennas. Moreover, they can coexist with the circuit parts mounted on a printed circuit board, as is shown in FIG. 1(B) and FIG. 2(B). Consequently, they can easily be housed inside the frame of communication equipment and can be miniaturized.

Second, although these inverted-L and inverted-F antennas 10, 20 are originally for use with vertically polarized waves, they also have horizontally polarized components, even though their radiation power has been reduced by about 20–30 dB. Therefore, even though they are single antennas, they have potentially a polarization diversity function.

However, a problem which tends to occur easily in the so-called plate antennas of this type of the past is the fact that it is difficult to match the impedance with the characteristic impedance of the feeder line.

For example, as mentioned above, the sum (L+H) of the height H of the vertical planar parts 11, 21 and the length L of the horizontal planar parts 12, 22 will necessarily be determined once the frequency f in use is determined. However, in most cases, it is desirable to reduce the height H of the vertical planar parts 11, 21.

In these cases, the antenna impedance generally tends to rise as the height H is reduced because of the increase of the parallel inductance. For this reason, mismatching of the impedance with the feeder line tends to occur easily.

Nevertheless, there are still ways of matching the impedance in these conventional antennas 10, 20 even if the height H is reduced. First, there is the method of adjusting the width W of the horizontal planar parts 12, 22. However, although there is no problem when this width W must be reduced, when it must be increased it becomes impossible to set it at the necessary width on account of the restrictions on the dimensions required in communication equipment. That is, there is not a very large degree of freedom in adjusting the impedance by adjusting the width W of the horizontal planar parts 12, 22.

On account of this, even among the conventional examples, if we compare the inverted-L antenna 10 shown in FIG. 1 with the inverted-F antenna shown in FIG. 2, one may say that the inverted-F antenna 20 shown in FIG. 2 is somewhat more advantageous with respect to adjustment of the impedance.

This is true for the following reason. In the inverted-L antenna 10 shown in FIG. 1, when the height H is restricted, one must rely solely on adjustment of the width W of the horizontal planar part 12 for adjusting the impedance. On the other hand, in the inverted-F antenna 20 shown in FIG. 2, even though both height H and width W may be restricted on account of dimensional requirements connected with miniaturization of the equipment, there still remains the means of adjusting the impedance by changing the lead-out position of the feeding point P, that is changing the distance D, or more realistically, by changing distances $d_1$ and $d_2$ in FIG. 2(B).

However, in actual fact, the range within which the impedance could be adjusted by these means was by no means sufficient. For this reason, restrictions were imposed on the dimensions of the equipment, and in most cases it was not possible to reduce the height H of the vertical planar part 21 very much.

In the case of the inverted-F antenna 20 in FIG. 2, which would seem to be somewhat superior to the inverted-L type, as mentioned above, there is an additional drawback in manufacturing of the equipment. That is, it becomes difficult to lead out the feeding point P when the distances $d_1$, $d_2$ concerning the feeding point P are adjusted in certain ways.

SUMMARY OF THE INVENTION

The object of this invention is to provide a highly suitable new antenna configuration which has a good efficiency, in which miniaturization is possible, and in which impedance matching can be done easily even if the dimensions of the main antenna parts and the lead-out position of the feeding point are restricted, that is, in which there is a high degree of freedom in adjusting the antenna impedance.

To attain the above object, the antennas of this invention for wireless communication equipment consist of a main vertical planar part which stands erect and one end of which is connected to the ground; a main horizontal planar part which extends at right angles towards the aforesaid main vertical planar part and one end of which is connected to the other end of the main vertical planar part; a secondary vertical linear part which faces towards and extends in parallel to the aforesaid main vertical planar part, and one end of which is connected to the feeding point; and a secondary horizontal linear part which extends in parallel to the aforesaid main horizontal planar part, separated from it by a definite distance, and one end of which is connected to the other end of the aforesaid secondary vertical linear part.

In the configuration of this invention, when configuring the prescribed dimensions in terms of the height (or length) of the main vertical planar part and the length of the main horizontal planar part -- generally a length corresponding to $\lambda/4$ with respect to the wavelength $\lambda$ of the frequency used --, it is possible to attain sufficient matching of the impedance with the feeder line since there is an extremely high degree of freedom in adjusting the impedance. This is true even in cases where matching of the impedance with the feeder line would be difficult without modifications. This is possible, firstly, because the height of the main vertical planar part has been reduced as necessary on account of requirements such as miniaturization of the wireless communication equipment on which the antenna is to be mounted, and, secondly, because the width of the main horizontal planar part could not be increased very much on account of restrictions based on the same reason.

First, it is possible to adjust the impedance by adjusting the distance separating the secondary horizontal linear part from the main horizontal planar part. Adjustments of this distance will not result in any increases of the antenna sizes.

Second, the aforesaid secondary horizontal linear part and the aforesaid main horizontal planar part are connected through a coupling part while maintaining the prescribed interval between them. It is also impossible to adjust the impedance by varying the position of the point where they are connected. Adjustments and changes of this point also will not result in any increases of the main dimensions of the antenna as a whole. Consequently, even if the lead-out position of the feeding point is fixed on account of reasons having to do with manufacturing, the impedance can be matched within a large range of adjustment by means of the two methods described above.

Furthermore, a first conductor width part having a first width can be mounted on the secondary horizontal linear part. This first conductor width part operates as a parallel capacitance in the manner of an equivalent circuit. Therefore, if this first conductor width part is present, capacitance will still be admitted in parallel even if the parallel inductance rises as a result of lowering the antenna height, and the rise of the antenna impedance can be suppressed. The amount of this parallel capacitance mounted can, of course, be adjusted by means of the width or length of the first conductor width part.

Moreover, if a second conductor width part having a second width is provided on the secondary horizontal linear part instead of or in addition to the aforesaid first conductor width part, it is possible to configure a capacitor for fine adjustment regardless of its width or length, that is, regardless of its area dimensions.

In particular, if this second conductor width part is located immediately under the other end of the main horizontal planar part, where the voltage has its largest value, it is also possible to adjust the central frequency in the antenna resonance system.

If the position where this second conductor width part is formed is moved along the length of the secondary horizontal linear part, it will be able to display the function of making fine adjustments of the impedance.

As is clear from these facts, the antennas of this invention have solved extremely rationally the problems in impedance matching, while retaining unchanged the advantages of the conventional inverted-L and inverted-F antennas.

In particular when the antennas of this invention are incorporated together with communication equipment circuits on printed circuit boards, it will generally be easiest and most desirable to locate the feeding point on a position along the surface of the printed circuit board. However, if this had been done in the inverted-F antennas of the past, this would have meant the loss of a degree of freedom in varying the position of the feeding point, which was the only remaining means of adjusting the impedance. On the other hand, this invention has the advantage that, even if this freedom is lost, no problems arise since there still remain at least two alternative degrees of freedoms.

It is clear from this that the antennas of this invention operate most effectively as built-in antennas in mobile or portable communication equipment, in which particular progress has been made in miniaturization. However, this is naturally not intended to restrict their application, and the antennas of this invention can be used effectively in their own way in stationary base stations as well.

It is also possible to obtain antennas with better radiation efficiency and reception sensitivity than the conventional inverted-L and inverted-F antennas. If the main vertical planar part is given a width different from the width of the main horizontal planar part and is made narrower, this can also contribute to converting them to nondirectional antennas.

DETAILED DESCRIPTION OF THE PREFERRED EMBODIMENTS

FIGS. 3(A)-(D) are schematic drawings of the configuration of various embodiments of the antennas 100 of this invention. FIGS. 3(E) and (F) show examples of somewhat different configurations in which the major parts of these embodiments are viewed from the side.

Figure 1:
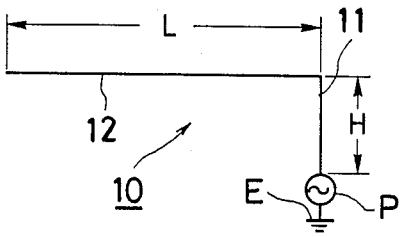
FIG. 1 (A) PRIOR ART
FIGS. 1(A) and (B) are schematic drawings of the configuration of a conventional inverted-L antenna.
Figure 1:
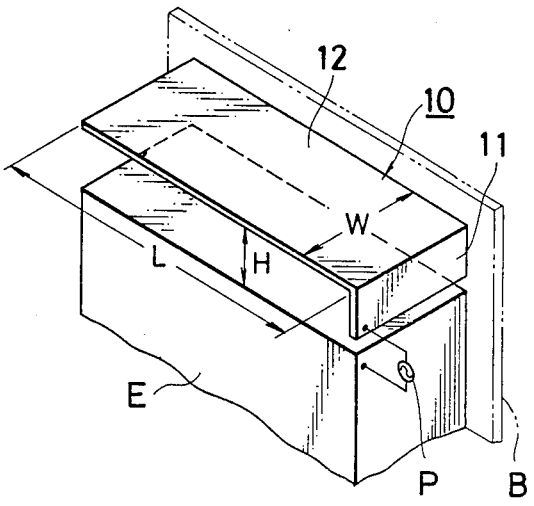
FIG. 1 (B) PRIOR ART
Figure 2:
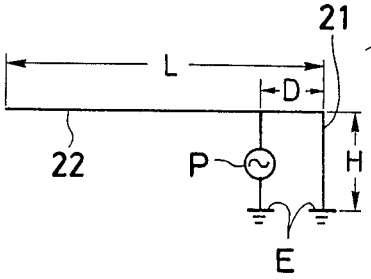
FIG. 2 (A) PRIOR ART
FIGS. 2(A) and (B) are schematic drawings of the configuration of a conventional inverted-F antenna.
Figure 2:
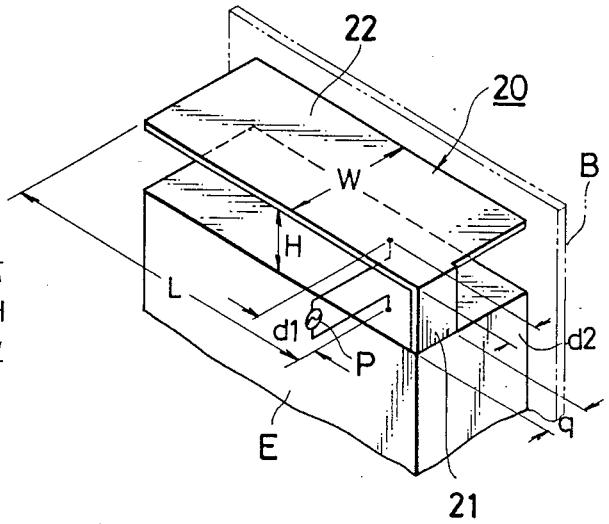
FIG. 2 (B) PRIOR ART
Figure 3A:
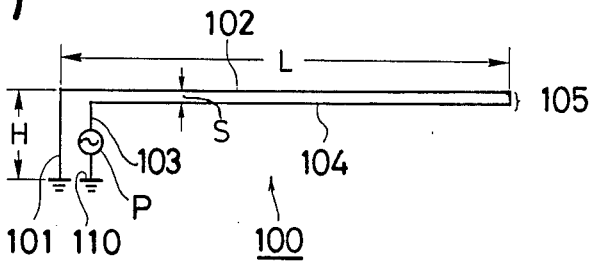
FIGS. 3(A)-(F) are schematic drawings of the configuration of various embodiments of antennas of this invention.

The embodiment shown in FIG. 3(A) is the most basic configuration of an antenna made up in accordance with this invention. First of all, it has a main vertical planar part 101 and a main horizontal planar part 102. One end of the main vertical planar part is connected to the ground 110, and it stands erect for a height (or length) H up to its other end. The main horizontal planar part 102 extends horizontally along a length L at right angles to the main vertical planar part 101, and one end of it is connected to the other end of this main vertical planar part 101.

Naturally, the words such as "right angles" or "parallel" are used here for the sake of convenience in explanation, and they have a meaning which allows some divergences from perfect right angles or parallels on account of factors such as the manufacturing tolerances in fabricating the actual elements or the precision of the manufacturing equipment.

That is, as is shown in FIG. 3(E) or (F), the aforesaid main vertical planar part 101 and main horizontal planar part 102 are plate-shaped or planar shaped and have widths of q and W, respectively. In the cases shown in the drawings, they both have the same width dimensions ($q=W$). However, it does not matter if $q' < W$, as when the width q of the main vertical planar part 101 has a cutting line at the imaginary line 101' for the reasons described below.

The main vertical planar part 101 and the main horizontal planar part 102 can be made, generally speaking, by bending and forming sheets of suitable conductive materials such as tinned or chromium-plated steel plates, as is seen also in the examples of antennas described below.

In addition, the antennas 100 of this invention have a secondary vertical linear part 103 and a secondary horizontal linear part 104. The secondary vertical linear part 103 stands up in parallel to the aforesaid main vertical planar part 101, and one end of it passes through the feeding point P and abuts on the ground 110. The secondary horizontal linear part 104 is at right angles to the secondary vertical linear part 103, extends in parallel to the aforesaid main horizontal planar part 102, separated by a distance s, and one end of it connects with the ascending end of this secondary vertical linear part 103.

In this embodiment illustrated in FIG. 3(A), the other end of this secondary horizontal linear part 104 is electrically connected by a coupling part 105 with the other end of the main horizontal planar part 102.

The secondary vertical linear part 103 and the secondary horizontal linear part 104 may be linear materials made of any suitable conductive material. In particular, they can be configured simply and rationally as conductive patterns formed on the printed circuit board 120 on which are mounted the circuit parts necessary for the communication equipment in question and which supports physically the main vertical planar part 101 and the main horizontal planar part 102, as shown in the examples of actual antennas given below.

On the other hand, the coupling part 105 may be either planar or linear in shape, but it naturally must have electrical conductivity, and it is convenient for it to be made of conductive lines patterned on the printed circuit board 120, as is seen in the examples of antennas described below.

In this first embodiment, when configuring a length corresponding to $\lambda/4$ with respect to the wavelength $\lambda$ of the frequency used f with a total length (L+H) equal to the total of the height H of the main vertical planar part 101 and the length L of the main horizontal planar part, it will be necessary to reduce the height H of the main vertical planar part 101 to a determined value on account of requirements of miniaturization of the wireless communication equipment on which this antenna 100 is to be mounted. When it is necessary to set the width W of the main horizontal planar part 102 also at a determined value, on account of restrictions based on the same reason, it is possible to adjust the antenna impedance by adjusting the distance s between the secondary horizontal linear part 104 and the main horizontal planar part 102 in order to dissolve the mismatching between the antenna impedance and the impedance of the feeder line. By adjusting this distance s, it is possible to avoid increasing the maximum dimensions of the antenna 100.

Figure 3B:
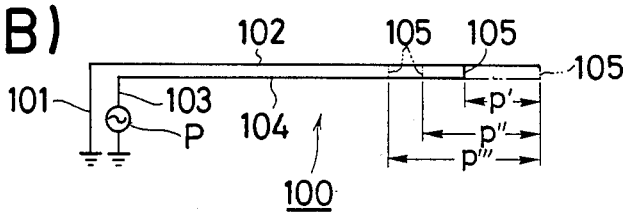

The basic embodiment shown in FIG. 3(A) can also be expanded in the manner shown in FIG. 3(B).

That is, in the basic embodiment above, the coupling part 105 for making electrical connections between the secondary horizontal linear part 104 and the main horizontal planar part 102 was positioned in the end position Po of the main horizontal planar part 102, but this connection position can be changed along the length of the main horizontal planar part 102, as is shown by distance p' in FIG. 3(B).

In addition, the antenna impedance can be adjusted similarly by changing and adjusting the connection position, as shown by distances p'', p''', . . . and by the coupling part 105 indicated by the imaginary lines.

This also means an increase in the number of degrees of freedom in adjusting the antenna impedance. In spite of this, these adjustments and changes do not result in any increases of the maximum dimensions of the antenna as a whole.

Therefore, even if the lead-out position of the feeding point P is limited and fixed, for example at a place immediately below one side of the main horizontal planar part 102 because of reasons having to do with manufacturing of the equipment, as is seen, for example, in the examples of antennas described below, it is still possible to perform the desired impedance matching because there still is a degree of freedom in adjusting the distance s and the distances p', p'', p''', . . . to the connection position of the coupling part 105, as described above.

Figure 3C:
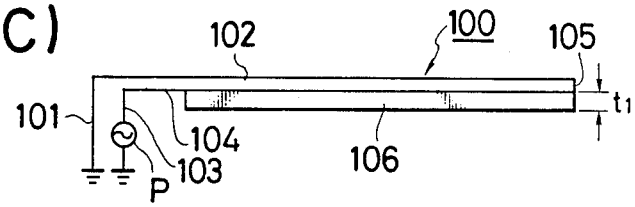

In addition, if the first conductor width part 106 having a first width $t_1$ is mounted on the secondary horizontal linear part 104 provided in this invention, as in the embodiment shown in FIG. 3(C), this first conductor width part 106 operates as a parallel capacitance in the manner of an equivalent circuit. Therefore, even though the parallel inductance may rise as a result of lowering the antenna height H, which is governed exclusively by the height of the main vertical planar part 101, the capacitance will still enter in parallel if this first conductor width part 106 is present, and it will be possible to suppress the rise of the antenna impedance.

Naturally, the amount of parallel capacitance mounted can be adjusted in accordance with the width $t_1$ of the first conductor width part 106 or its length.

Of course, when it is actually being manufactured, this first conductor width part 106 can be configured as a structural member essentially integrated with the secondary horizontal linear part 104, as is seen in the examples of antennas described below. This can be done by adjusting the conductor width along the elevation direction of the secondary horizontal linear part 104.

Figure 3D:
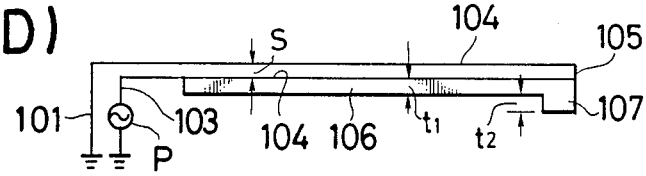
Figure 3E:
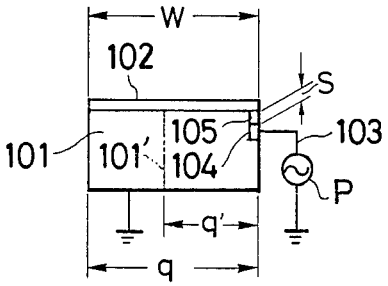

FIG. 3(D) shows another preferred embodiment. In the case shown, the second conductor width part 107 having a second width $t_2$ greater than the aforesaid first width $t_1$ is provided on the secondary horizontal linear part 104, on the end of the aforesaid first conductor width part 106 facing towards the secondary vertical linear part 103.

Figure 4:
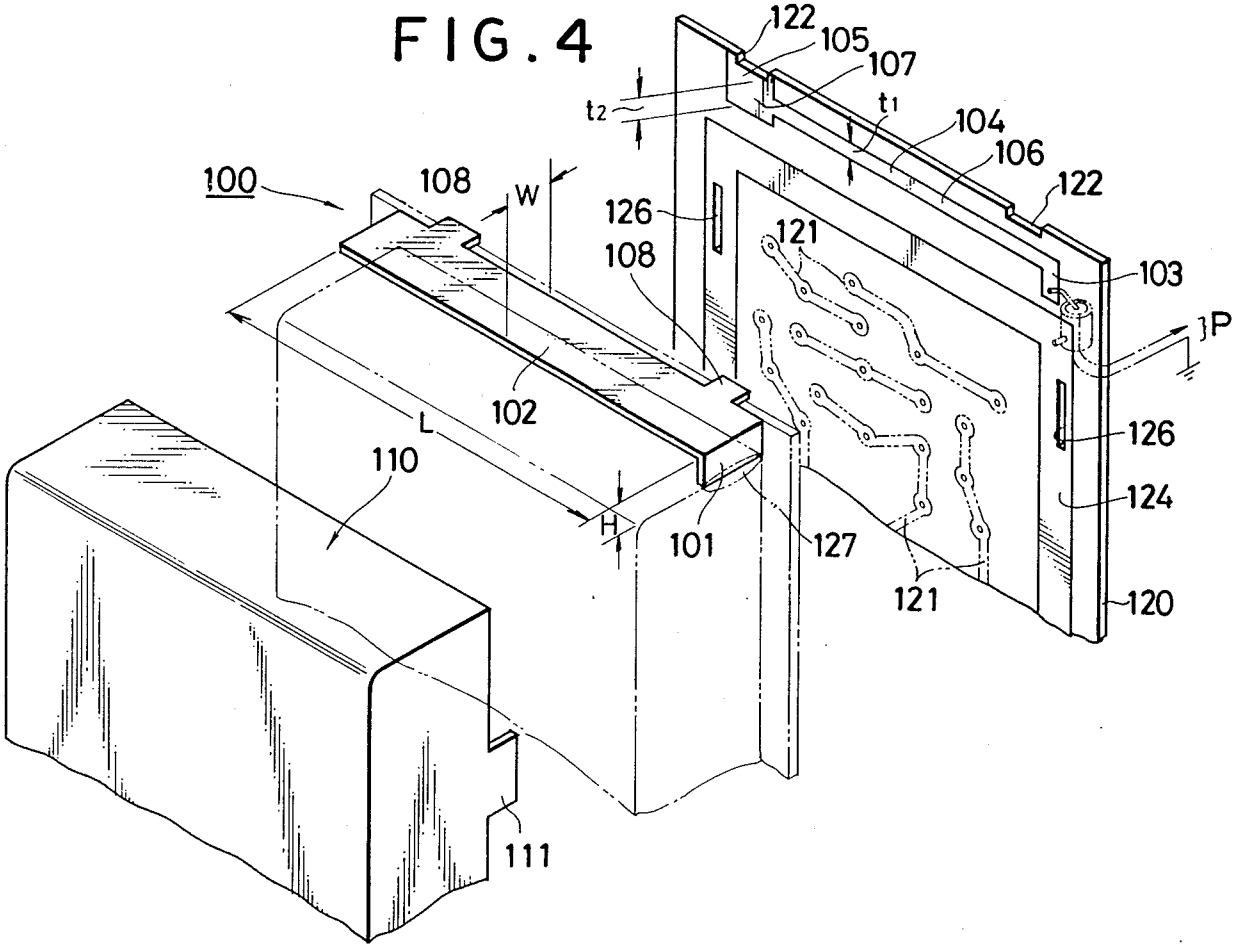
FIGS. 4 and 5 are schematic drawings of the configurations of examples of antennas of this invention configured in accordance with FIG. 3.

This means that a capacitor for fine adjustments is configured here, depending upon its width $t_2$ or length, or in the final analysis its area dimensions. If this second conductor width part 107 is located immediately under the end part of the main horizontal planar part 102 on the side facing towards the main vertical planar part 101, where the distributed voltage reaches its maximum value, as in this embodiment, it is possible to adjust effectively the center frequency fo in the antenna resonance system. An example of an actual antenna is shown in FIG. 4.

If the position where this second conductor width part 107 is formed is varied along the length of the secondary horizontal linear part 104, it will also be able to display the function of making fine adjustments of the impedance, just as in the case of the first conductor width part 106 mentioned above. That is, it is not always necessary for this second conductor width part 107 to coexist with the first conductor width part 106, and it alone may be located on the secondary horizontal linear part 104.

Figure 3F:
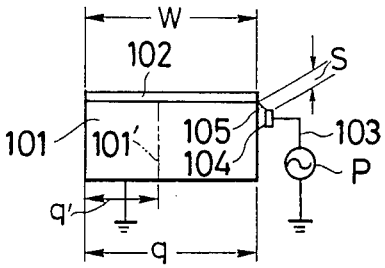

As is shown in FIG. 3(E) or FIG. 3(F), in actual fact, the position where the secondary horizontal linear part 104 is located can be, in principle, selected freely, to a certain degree, in the direction of the width W of the main horizontal planar part 102. The antenna impedance can also be varied and adjusted in accordance with its position.

For example, in the case shown in FIG. 3(E), this secondary horizontal linear part 104, and also the aforesaid first and second conductor width parts 106, 107 (when they are mounted on this secondary horizontal linear part 104), are located immediately below one side of the main horizontal planar part 102, separated by a distance s. In the case shown in FIG. 3(F), they are located at an oblique position outside from the point immediately below one end of the main horizontal planar part 102, separated by a distance s.

In addition, they may also be located at a position even further inward from the position shown in FIG. 3(E). However, in actual fact, it is preferable to locate them in a position more or less directly below one end of the main horizontal planar part, as is shown in FIG. 3(E). This is so because the printed circuit board is provided along this end in the examples of antennas described below, and consequently the simplest and most rational fabricating method is that of wiring the secondary vertical linear part 103, the secondary horizontal linear part 104, as well as the first and second conductor width parts 106, 107 and the coupling part 105 by patterning them on this printed circuit board.

Figure 5:
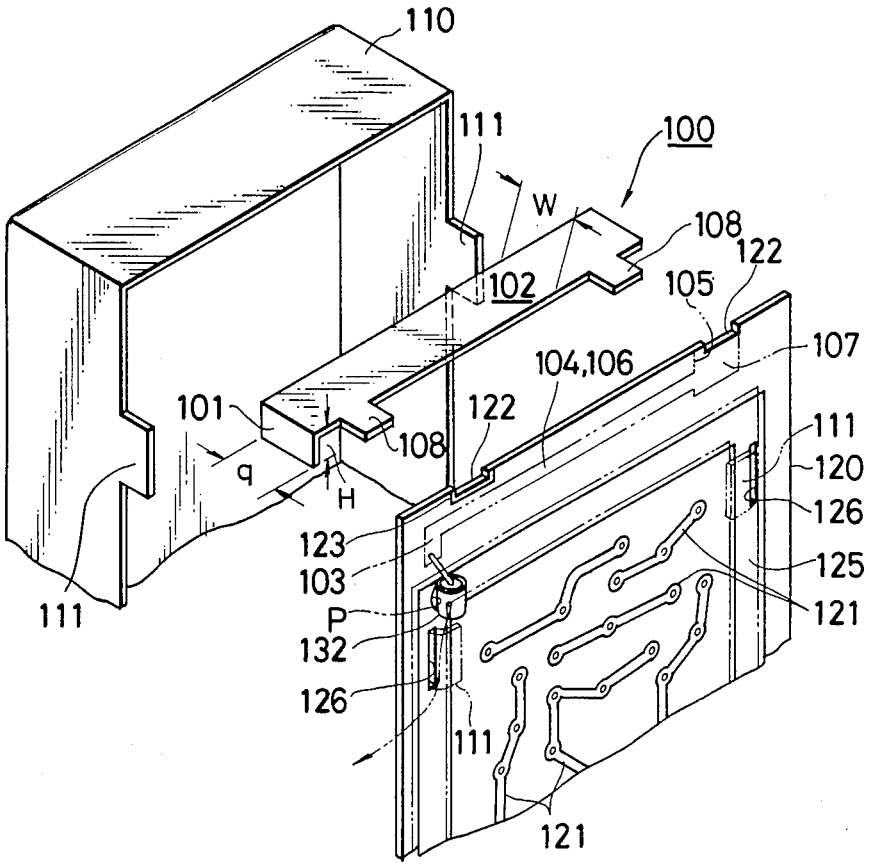

FIGS. 4 and 5 illustrate an actual antenna fabricated on the basis of the preferred embodiment shown in FIG. 3(D). For reference purposes, a cordless telephone was selected as the applicable communication equipment.

The printed circuit board 120 is shown in these drawings. It may be made of a suitable existing, publicly known material such as glass epoxy, and the conductor patterns 121 for mounting the group of circuit parts needed to configure the applicable communication equipment are formed by ordinary patterning techniques on the part of the board with the board area.

In the case illustrated in the drawings, these patterns are on one side of the board, but double-sided patterns are actually used most frequently, since chip parts are used in most cases.

In this example of an antenna, the antenna 100 of this invention is formed along the width part of a predetermined area on the upper edge of the printed circuit board 120.

That is, the main vertical planar part 101 and the main horizontal planar part 102 which are necessary to an antenna 100 of this invention are obtained by bending and forming suitable steel plates with tinning or chrome plating to height H and length L. Since these principal parts 101, 102 are physically fastened to the corresponding positions on the printed circuit board 120, two tongues 108, separated by an interval, are provided on one side of the main horizontal planar part 101.

Naturally, these tongues 108 may be formed by blanking at the same time as the press-forming prior to the aforesaid bending. However, the tongue 108 located towards the back in the drawing not only serves for physically fastening the parts, but also contributes to the electrical connections as a part of the coupling part 105.

Notches 122 into which to fit the tongues 108 are first formed on the upper edge of the printed circuit board 120. Along the notch 122 located towards the front in the drawings, a conductive pattern 123 is provided on the plane opposite to the plane where the antenna of this invention is located. It is for the purpose of fastening by soldering the tongue 108 when it is fitted inside the notch 122, and it does not play any particular role in the circuitry.

A conductive pattern 105 corresponding to the coupling part 105 mentioned in connection with the embodiments in FIG. 3 is formed along the notch 122 located to the rear, as is shown in FIG. 4. The conductive pattern 104 of the secondary horizontal linear part 104, which extends along the upper edge of the printed circuit board, is formed in connection with it, but extending in a rectangular direction.

The conductor width $t_1$ of the conductive pattern 104 is equivalent to that making up the first conductor width part 106 in the embodiments shown in FIG. 3(C) or (D). Moreover, the conductive pattern 107 which is formed continuously below the coupling part 105 corresponds to the second conductor width part 107 having second conductor width $t_2$ in the embodiment shown in FIG. 3(D).

Similarly, as is shown in FIG. 4, the opposite end of the secondary horizontal linear part 104 extending along the upper edge of the printed circuit board 102 forms a conductive pattern 103 bending downwards, and this part 103 corresponds to the secondary vertical linear part 103 described thus far.

Consequently, the feeding point P is formed between the bottom of this secondary vertical linear part 103 and the ground. In this embodiment, the grounding pattern 124 surrounds the pattern planar parts making up the circuits of the printed circuit board. Therefore, through holes or suitable rod-shaped conductive components are made to penetrate through to the rear surface of the printed circuit board from the surface facing towards the antenna 100. In this way, suitable connectors 132 are provided, by which the conductive outer housing is connected and fastened by soldering to the grounding pattern 125 on the rear surface, and connections are made in this way with the circuit system, as is shown in FIG. 5. These connectors 132 are not given in detail, since various types of them are well known in the art of connecting antennas of this type.

The lower ends of the main vertical planar part 101 must have connections with the ground 110. In this embodiment, the ground 110 is formed on the top surface part of the shield housing 110 which shields the parts making up the circuitry on the printed circuit board 120.

A number of projections 111 (two are shown in the example illustrated in the drawings) are formed on the side parts of the shield housing 110 in order to fasten it physically to the printed circuit board 120.

These projections 111 are first inserted inside the projection insertion holes 126 provided in the printed circuit board 120 so that they will penetrate through at the location of the grounding patterns 124, 125. Then they are bent on the rear side of the printed circuit board 120, as is shown by the imaginary lines in FIG. 5, or they may also be soldered in place after having been bent. In this way, the shield housing 110 is located over the printed circuit board 120, is fastened in place while covering the circuit parts, and is also connected electrically with the grounding pattern 124 (or 125). This enables it to fulfill the shield function which is its purpose.

If this housing, after it has been placed on the printed circuit board 120 in this way, is electrically connected to the bottom of the main vertical planar part 101 of the antenna 100 of this invention, as in the soldered part 127 shown by the imaginary lines in FIG. 4, it will also be able to function as the ground 110 with respect to the antenna 100 of this invention.

Therefore, after the tongues 108 provided on the main horizontal planar part 102 of the antenna 100 have been fitted into the corresponding notches 122, as mentioned above, they are fastened by soldering or the like to the coupling part 105 and to the conductive pattern 123 for use in fastening. Then they will be able to provide at the same time both physical fastening and electrical connections with the coupling part 105. With this, the antenna 100 is incorporated onto the printed circuit board 120 and completed.

Of course, since FIGS. 4 and 5 are oblique drawings, they do not show the relative dimensions and relative positions in detail. However, the relative placements of the various parts of the antenna 100 of this invention when completed in this manner will correspond to those in the embodiment shown in FIG. 3(D).

However, as is shown in the relationship between FIGS. 3(E) and (F), the secondary vertical linear part 103, the secondary horizontal linear part 104, and the coupling part 105 may also be formed on the rear side of the printed circuit board 120. The coupling part 105 may be formed in a planar shape, with the tip of the main horizontal planar part 102 bent back downwards, and it may be connected to the secondary horizontal linear part 104 by bringing one end of it in contact with the conductive patterns formed on the printed circuit board.

It is obvious that the embodiments shown in FIGS. 3(A)–(C) can also be facricated by approximately the same procedures and techniques. Especially in cases where the first conductor width part 106 and the second conductor width part 107 are made unnecessary, as in the embodiments shown in FIGS. 3(A) and (B), it will be sufficient to adopt a method in which the patterning in FIGS. 4 and 5 is intentionally made quite fine so that the conductor widths containing the secondary horizontal linear part 104 will not have capacitance components which are too large.

In any case, such embodiments are desirable even when considered from the viewpoint of the shape alone, since an antenna 100 necessary for the applicable communication equipment can be incorporated into it by merely adding the area of the inverted-L plate parts 101 and 102 to the area needed by the conventional circuits formed on the printed circuit board 120. The antenna does not need to be exposed on the outside of the communication equipment. This gives the communication equipment a smart shape and is most suitable in miniaturizing the equipment.

Furthermore, the height H and width q of the main vertical planar part 101 and the length L and width W of the main horizontal planar part are determined by factors of dimensional design in miniaturizing the communication equipment. Furthermore, even if the lead-out position of the feeding point P is fixed, as is shown in FIGS. 4 and 5, adjustment of the antenna impedance can still be adjusted with a large degree of freedom, by means of the placement position of the coupling part 105 and by the width design during patterning of the width $t_1$ of the first conductor width part 106, as has already been described. If, for example, the width $t_2$ of the second conductor width part 107 is made variable, this can be regarded as a variation of the central frequency fo in the antenna resonance system.

Figure 6:
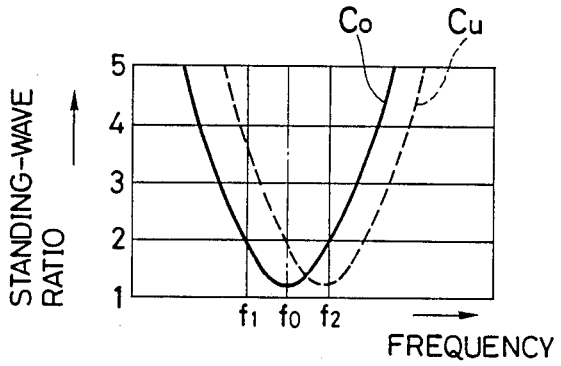
FIG. 6 is an explanatory diagram of adjustment of the central frequency of the resonance system in an embodiment of the antennas of this invention.

In a case where, for example, the width $t_2$ of the second conductor width part 107 had a certain optimal width, let us suppose that a curve matching the central frequency fo had been obtained, as in curve Co shown by the solid line in FIG. 6. In such a case, if the conductor width $t_2$ is made even smaller, the characteristics will shift towards the higher frequency side, as in curve Cu shown by the broken line. Naturally, the characteristics will shift in the opposite direction, towards the lower frequency side, if the conductor width $t_2$ is increased. The width of this shift can be quite large. Therefore, it is possible to attain a high degree of freedom in adjusting the central frequency fo by using a preferred embodiment of this invention in which the second conductor width part 107 is on the secondary horizontal linear part 104, as described here.

Figure 7A:
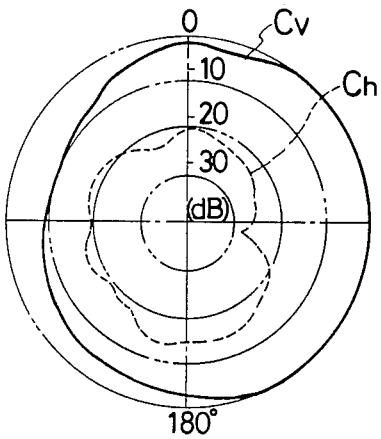
FIGS. 7(A) and (B) are characteristic drawings concerning the directivity obtained by actual examples of antennas of this invention.

FIGS. 7(A) and (B) show the directivity characteristics obtained with antennas of this invention fabricated in accordance with the foregoing examples. The antennas were actually used in both the portable side (remote unit side) of a cordless telephone and in its base station side (base unit side).

Figure 7B:
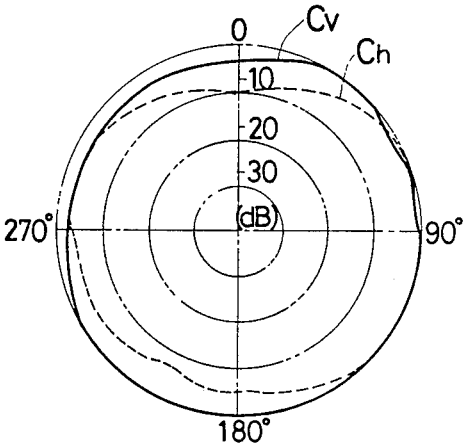

FIG. 7(A) shows the characteristics obtained when the antenna was used in the portable side, and FIG. 7(B) shows those obtained when it was used in the base station side. Curve Cv, shown by the solid line in FIG. 7(A) plots the vertical polarization directivity of the antenna incorporated in the portable side. There is no observable null point, even though there is a drop in sensitivity, on account of the influence of the main vertical planar part 101, in the 270° direction, which is the direction where it is installed in the case shown in the figure. The results may be considered to display a non-directivity virtually near the ideal.

In this connection, a rounder non-directivity can be achieved if the width q of the main vertical planar part 101 is made narrower, as shown by q′ in FIGS. 3(E) and (F), as described above. The fact that the remaining width parts q′ are different on the left and on the right in FIGS. 3(E) and (F) indicates that it does not matter on which side the width is made narrower.

Furthermore, the antenna 100 displays a non-directivity, with no extreme null points, for the horizontally polarized components as well, even though the level is about 10–20 dB lower than the vertically polarized components, as is shown by curve Ch indicated by the imaginary line in FIG. 7(A).

Consequently, it is clear that the antenna of this invention used on the portable side has a polarization diversity function displaying a sensitivity to incoming waves from all directions.

In the antenna of this invention on the base station side, it is clear from FIG. 7(B) that the non-directivity is higher both vertically and horizontally, even though the antenna proper is exactly the same as that used on the portable side.

It is believed that this is because the various control circuits in the equipment on the base station side are more complicated than those on the portable side, and there are also circuit parts for connections with the telephone lines. Therefore, since the shield housing 110 contains them, the dimensions are larger than those of the portable side. As a result, the ground 110 has a larger area from the antenna's viewpoint. In any case, it is certain that those characteristics are quite desirable.

The aforesaid antennas are merely examples, and this invention is not limited to them alone. How actually to fabricate the antennas of this invention shown in the drawings in FIG. 3 is a question left to the selection of the person skilled in the art who employs this invention.

What is claimed is:

1. An antenna for wireless communication equipment, said antenna having a feeding point at which sigals are coupled to and from said antenna, comprising:

a conductive main vertical planar part having a first width, standing erect, and having one end thereof connected to the ground;

a conductive main horizontal planar part having a second width, extending at substantially right angles toward said main vertical planar part, and having one end thereof connected to the other end of said main vertical planar part;

a conductive secondary vertical linear part facing toward and extending in parallel to said main vertical planar part, and having one end thereof connected to the feeding point;

a conductive secondary horizontal linear part extending in parallel to said main horizontal planar part, having one end thereof connected to the other end of said secondary vertical linear part, and separated from said main horizontal planar part by a distance selected to provide a predetermined desired impedance at the feeding point; and a coupling part for electrically connecting the other end of said secondary horizontal linear part to said main horizontal planar part.

2. The antenna according to claim 1, wherein said coupling part electrically connects the other end of said secondary horizontal linear part to the other end of said main horizontal planar part.

3. The antenna according to claim 1, wherein said coupling part electrically connects the other end of said secondary horizontal linear part to a portion of said main horizontal planar part at a location between the ends of said main horizontal planar part.

4. The antenna according to claim 1, wherein said secondary horizontal linear part is provided with a first conductor width part having a first width and making up a capacitor for impedance adjustment.

5. The antenna for wireless communication equipment of claim 4, wherein said secondary horizontal linear part is provided with a second conductor width part having a second width and making up a capacitor for finely adjusting the center frequency.

6. The antenna according to claim 1, wherein said horizontal linear part is provided with a conductor width part having a width and making up a capacitor for finely adjusting the center frequency.

7. The antenna according to claim 1, wherein the main vertical planar part and the main horizontal planar part are made up by forming steel sheets in an L-shape, and the secondary vertical linear part and the secondary horizontal linear part are formed by printing on a circuit board.

* * * * *